US011602212B2

(12) United States Patent
Chariot et al.

(10) Patent No.: US 11,602,212 B2
(45) Date of Patent: Mar. 14, 2023

(54) COSMETIC CASE

(71) Applicant: Beauty Molecules International Limited, London (GB)

(72) Inventors: Pierre Chariot, Dubai (AE); Ralph Chami, Dubai (AE); Natalie Cox, Dubai (AE); Audrey Bois Nicolai, Dubai (AE); Celine Talabaza, Madrid (ES)

(73) Assignee: Beauty Molecules International Limited, London (GB)

( * ) Notice: Subject to any disclaimer, the term of this patent is extended or adjusted under 35 U.S.C. 154(b) by 0 days.

(21) Appl. No.: 17/573,004

(22) Filed: Jan. 11, 2022

(65) Prior Publication Data

US 2022/0125181 A1 Apr. 28, 2022

(51) Int. Cl.
*A45D 40/24* (2006.01)
*A45D 40/22* (2006.01)

(52) U.S. Cl.
CPC ..... *A45D 40/24* (2013.01); *A45D 40/22* (2013.01); *A45D 2040/227* (2013.01)

(58) Field of Classification Search
CPC ..... A45D 2040/227
See application file for complete search history.

(56) References Cited

FOREIGN PATENT DOCUMENTS

| | | |
|---|---|---|
| KR | 200457672 | 12/2011 |
| KR | 20140110158 | 9/2014 |
| WO | 199117941 | 11/1991 |

OTHER PUBLICATIONS

International Search Report, dated Sep. 23, 2022, PCT/EP2022/058836 Corresponding PCT Application to the US Application).

*Primary Examiner* — Mollie Impink
(74) *Attorney, Agent, or Firm* — Adam K. Sacharoff; Much Shelist, P.C.

(57) ABSTRACT

In one embodiment there is provided a cosmetic case for holding at least one sachet. The case includes a refillable and removable sleeve that holds the at least one sachet. The case includes a spring biases a platform that keeps the sachets in position for a user to take one when the case is opened.

19 Claims, 12 Drawing Sheets

COSMETIC CASE

FIELD OF THE INVENTION

The present invention relates to small handheld case, and more particularly to a Cosmetic Case that allows the user to remove single dose applicator sachets.

BACKGROUND OF THE INVENTION

Small cosmetic cases are well known in the industry. However, there is always a need to design and create unique cosmetic cases specifically engineered to solve a purpose. As opposed to a cosmetic case that contains an open cosmetic, which can dry out or spill. As such, the industry has developed cosmetic cases to hold pre-packaged single dose sachets. These sachets can contain applicators, wipes, or creams used on the face or hands and then discarded. However, the cases holding these single sachets are often not user friendly and do not easily allow for the refilling of the single doses. Therefore, there is a need over the prior art to an invention that is capable of providing a easy to use, easy to refill cosmetic case.

SUMMARY OF THE INVENTION

In one embodiment of the present invention there is provided a cosmetic case for holding at least one sachet. The case includes a lid connected to a base by a hinge along the rear portion of the case. The base can be defined to include a base lower surface terminating to a base edge. A continuous base side wall extends upwardly from the base edge to define a base well therebetween. The base side wall extends to a base side wall upper edge. The case further includes a spring secured at one end to the base lower surface, and having another distal end secured to a platform such that the spring biases the platform away from the base lower surface. The case also includes a base substructure fitted and secured into the base well. The substructure has a top ridge extending radially inward towards a circular indentation and then an inner periphery edge. An inside surface wall extends from the inner periphery edge downwardly towards a lower ridge that extends radially inward, wherein the lower ridge is adjacent the base lower surface and defining a sub-well between the inside surface wall. At least one channel along the inside surface wall extends from the inner periphery edge to the lower ridge. Each of the at least one channels further includes a longitudinal directed notch near the lower ridge. A sleeve is removably fitted into the base substructure. The sleeve is defined to include a top surface region extending inwardly to a sleeve side wall extending downwardly to define a sleeve well. The top surface region further has a raised overhang lip that hangs over a portion of the sleeve well. A side opening under the top surface region configured to receive at least one sachet. At least one protruding knob positioned on the outside of the sleeve side wall and configured to slide in the channel and notch. Therein the sleeve is configured to be removed from the substructure and secured within the substructure. Lastly, at least one sachet that is shaped to be held in the sleeve well and being removable when the lid is in an open configuration from between the platform and the raised overhang lip defined on the sleeve.

In another embodiment of the invention, the sleeve further includes a circular extension under the top surface region and around the terminal edge being sized to fit into a circular indentation defined on the top ridge of the substructure, thus when the sleeve well is fitted into the sub-well the sleeve is able to twist about the substructure.

In yet another embodiment of the invention the at least one channel includes two channels distally positioned around the inside surface wall, each channel separately accommodating a protruding knob defined on the sleeve. It is also possible that the at least one channel is wider near the inner periphery edge and tapers to a narrower opening near the lower ridge.

In further embodiments the lid includes: a lid top surface extending to a lid terminal edge; a lid shoulder section extending from the terminal edge downwardly towards the base and ending at a lid shoulder lip; and a lid inner surface defined about the lid top surface configured to include an indented profile. The indented profile on the lid inner surface is configured to accommodate a raised portion defined on the sleeve.

In another aspect of the invention, the substructure has an outside surface wall that extends to a height above the base side wall upper edge, configured to prevent the base side wall upper edge to come into contact with the lid shoulder lip defining a gap between the lid and base when the case is in a closed configuration.

The cosmetic case in a different embodiment may define the base side wall configured to include a gap along the base side wall upper edge and along the rear portion to accommodate a flange extending from the lid and which aligns with openings for a pin to form a hinge pin.

The cosmetic case in yet a different embodiment may comprise an overhang stop extending over the sub-well and configured to come into contact with a portion of a bottom ridge defined at a bottom of the side opening in the sleeve to prevent the complete removal of the sleeve from the substructure.

In yet further embodiments there may be provided a cosmetic case for holding at least one sachet. The case can be defined to have (a) a lid connected to a base substructure by a hinge along the rear portion of the case; (b) a base substructure defined to include: a base substructure lower surface terminating along an outside side wall that extends upwardly to a top ridge which extends radially inward towards a circular indentation and then an inner periphery edge, the base substructure further includes an inside surface wall extending from the inner periphery edge downwardly towards the base substructure lower surface to define a sub-well between the inside surface wall; at least one channel along the inside surface wall extending from the inner periphery edge towards the base substructure lower surface, the at least one channel further including a longitudinal directed notch near the base substructure lower surface; (c) a sleeve removably fitted into the base substructure; the sleeve defined to include: a top surface region extending inwardly to a sleeve side wall extending downwardly to define a sleeve well, the top surface region further has a raised overhang lip that hangs over a portion of the sleeve well, a side opening under the top surface region configured to receive at least one sachet; and at least one protruding knob positioned on the outside of the sleeve side wall and configured to slide in the channel and notch, thereby the sleeve is configured to be removed from the substructure and secured within the substructure; (d) a spring secured at one end to the base substructure lower surface, and having another distal end secured to a platform such that the spring biases the platform away from the base substructure lower surface; and (e) at least one sachet being shaped to be held in the sleeve well and being removable when the lid is in an open configuration.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE DRAWINGS

Figure 1:
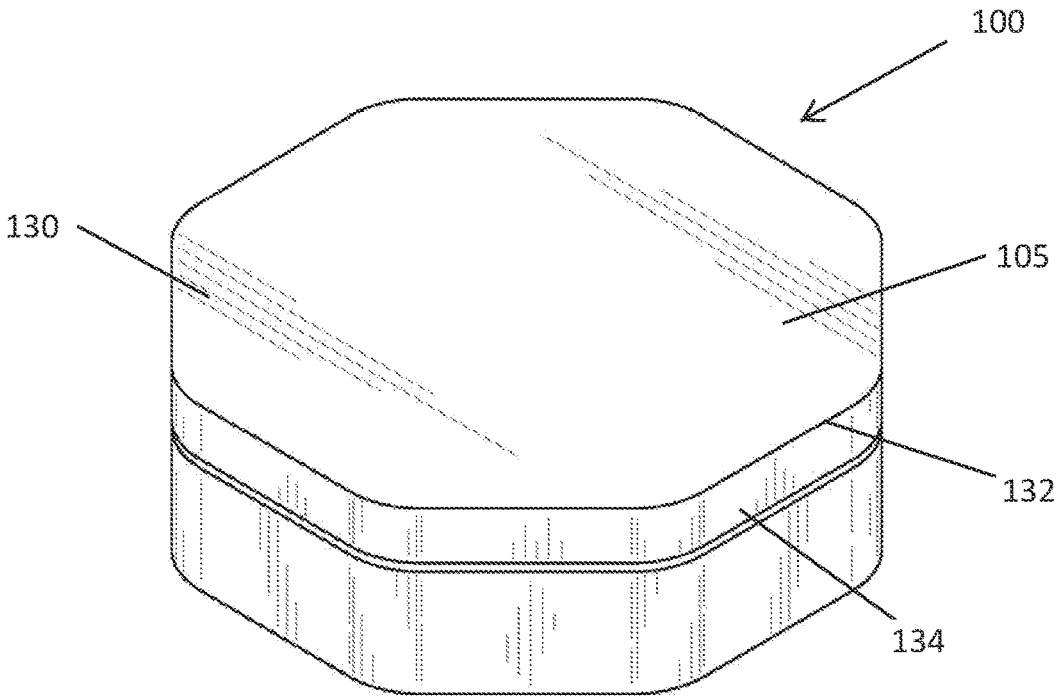
FIG. 1 is a perspective view of the cosmetic case in accordance with an embodiment of the invention.
Figure 2:
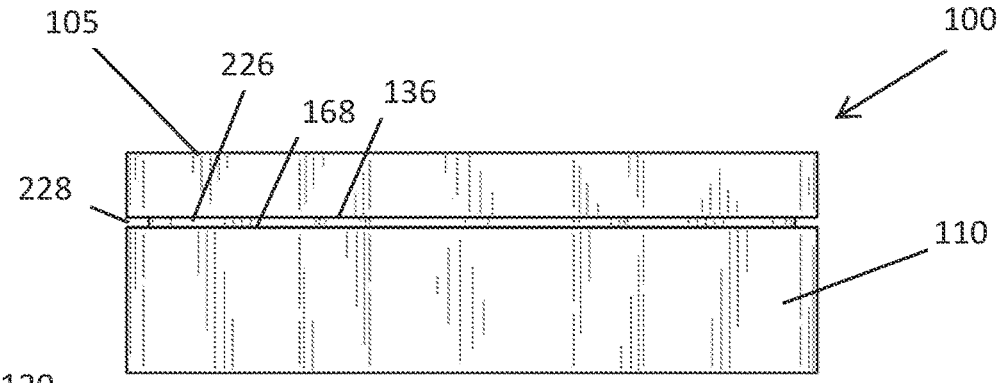
FIG. 2 is front view of the cosmetic case in accordance with an embodiment of the invention.
Figure 3:
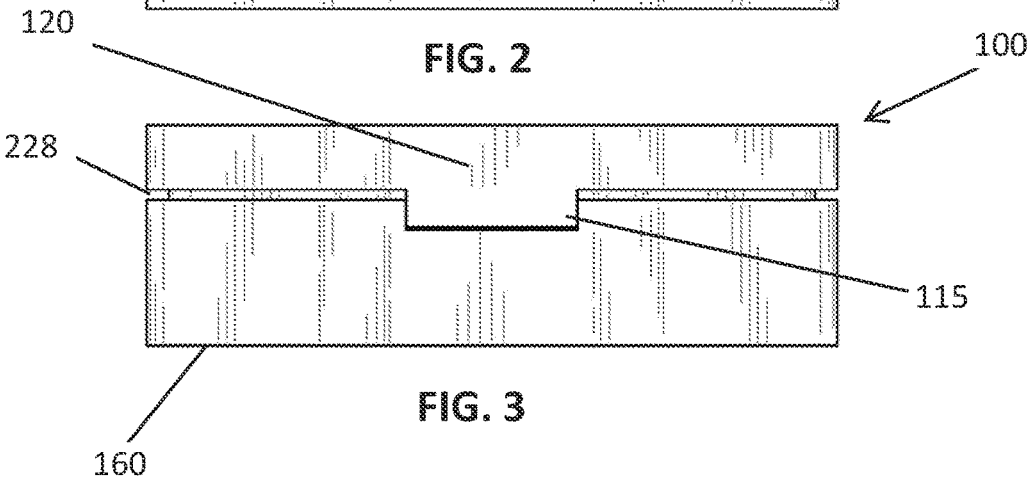
FIG. 3 is a rear view of the cosmetic case in accordance with an embodiment of the invention.
Figure 4:
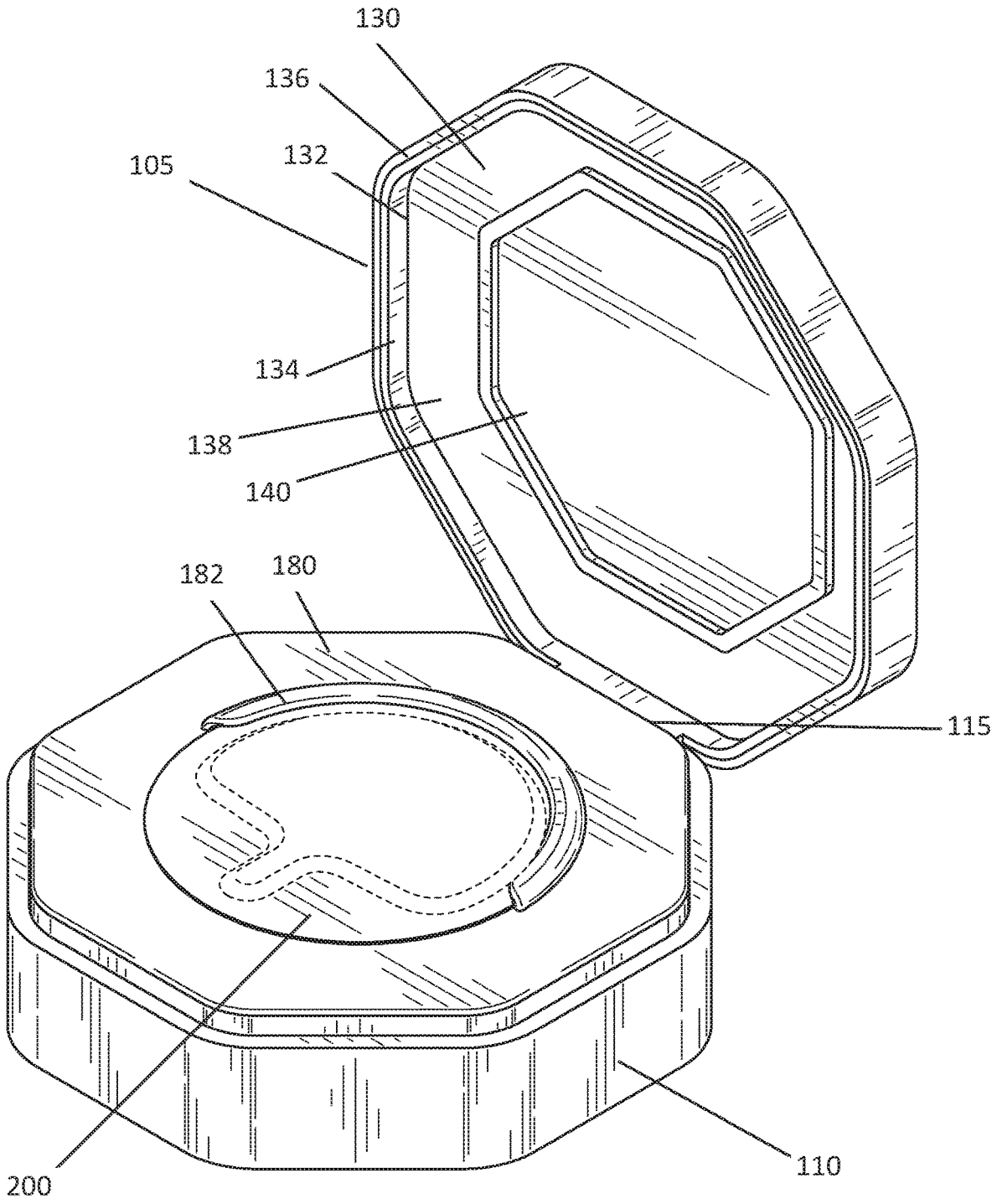
FIG. 4 is a perspective view of the cosmetic case in an open configuration in accordance with an embodiment of the invention.
Figure 5:
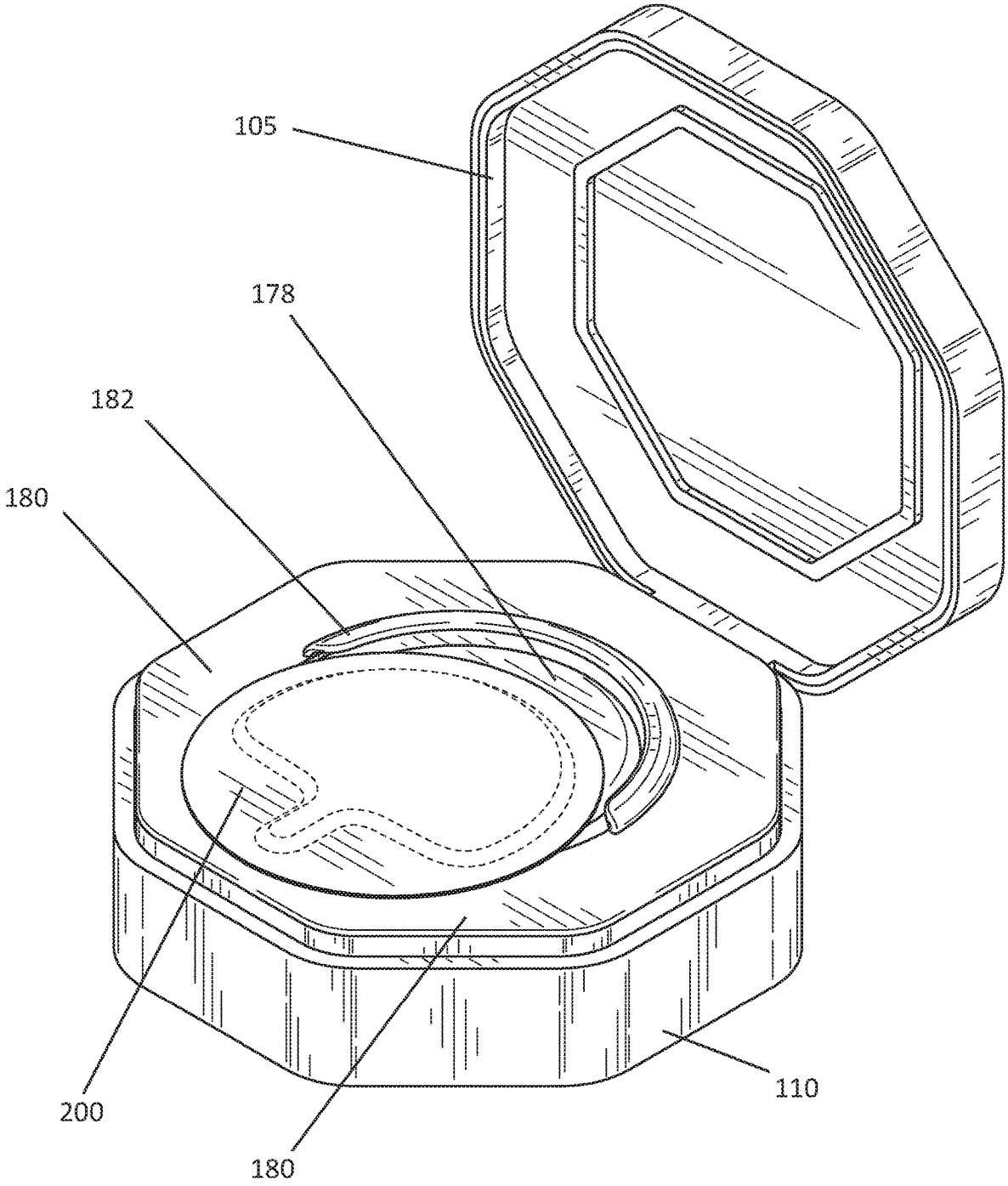
FIG. 5 is a perspective view of the cosmetic case in an open configuration and with a sachet being removed in accordance with an embodiment of the invention.
Figure 6:
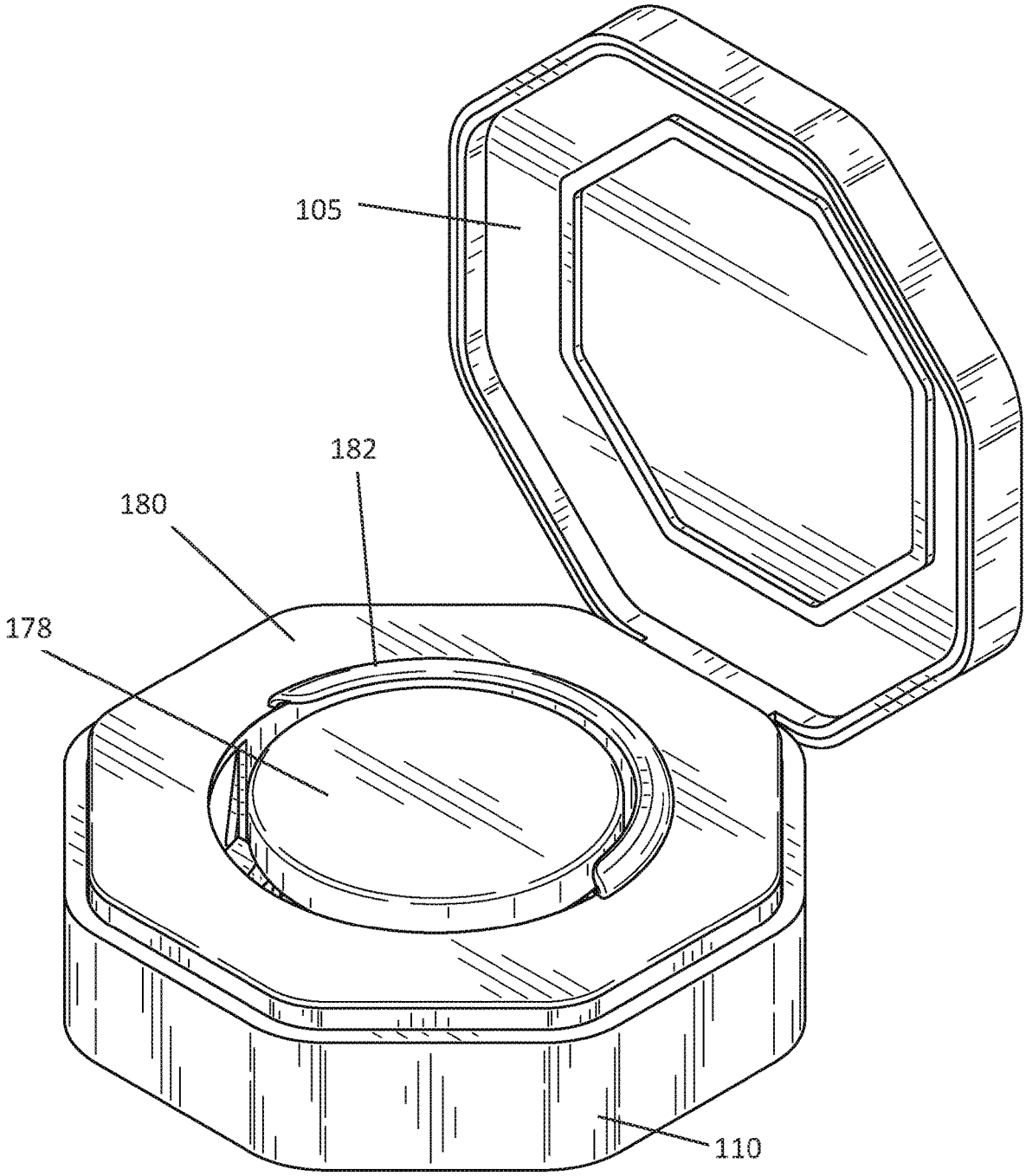
FIG. 6 is a perspective view of the cosmetic case in an open configuration in accordance with an embodiment of the invention.
Figure 7:
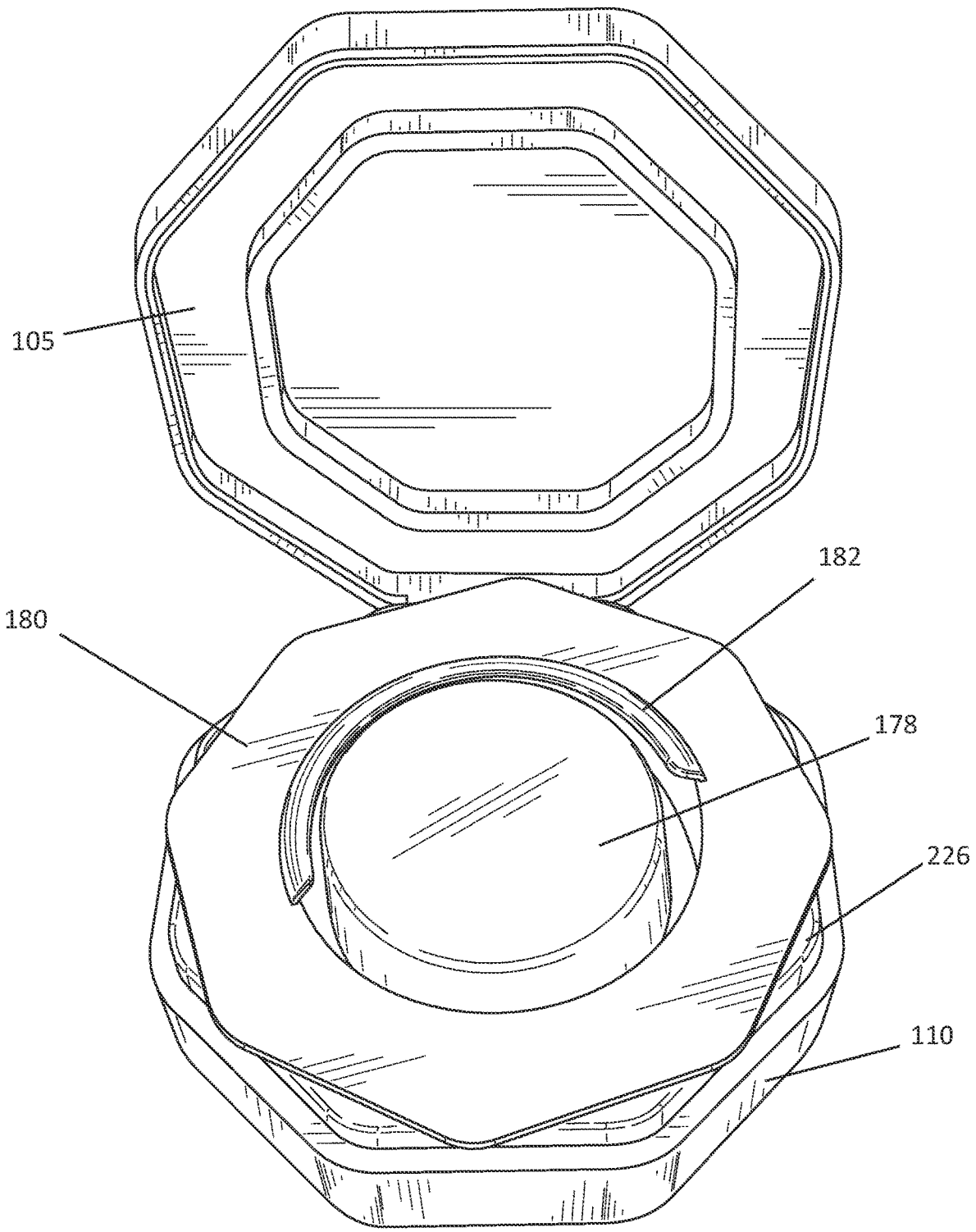
FIG. 7 is a perspective view of the cosmetic case in an open configuration and with the sleeve being rotated for separation from the case in accordance with an embodiment of the invention.
Figure 8:
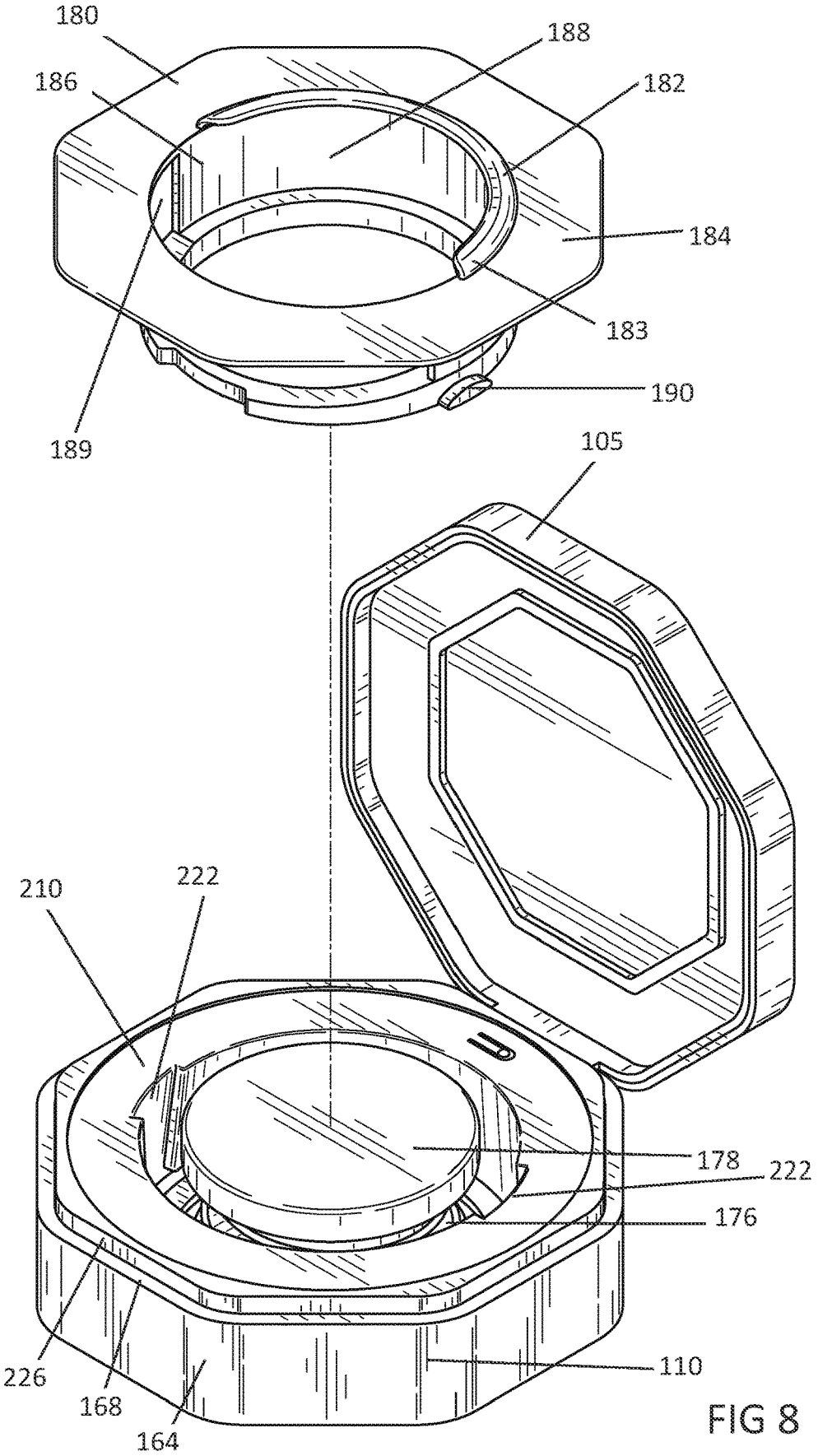
FIG. 8 is a partial exploded view showing the separation of the sleeve from the case in accordance with an embodiment of the invention.
Figure 9:
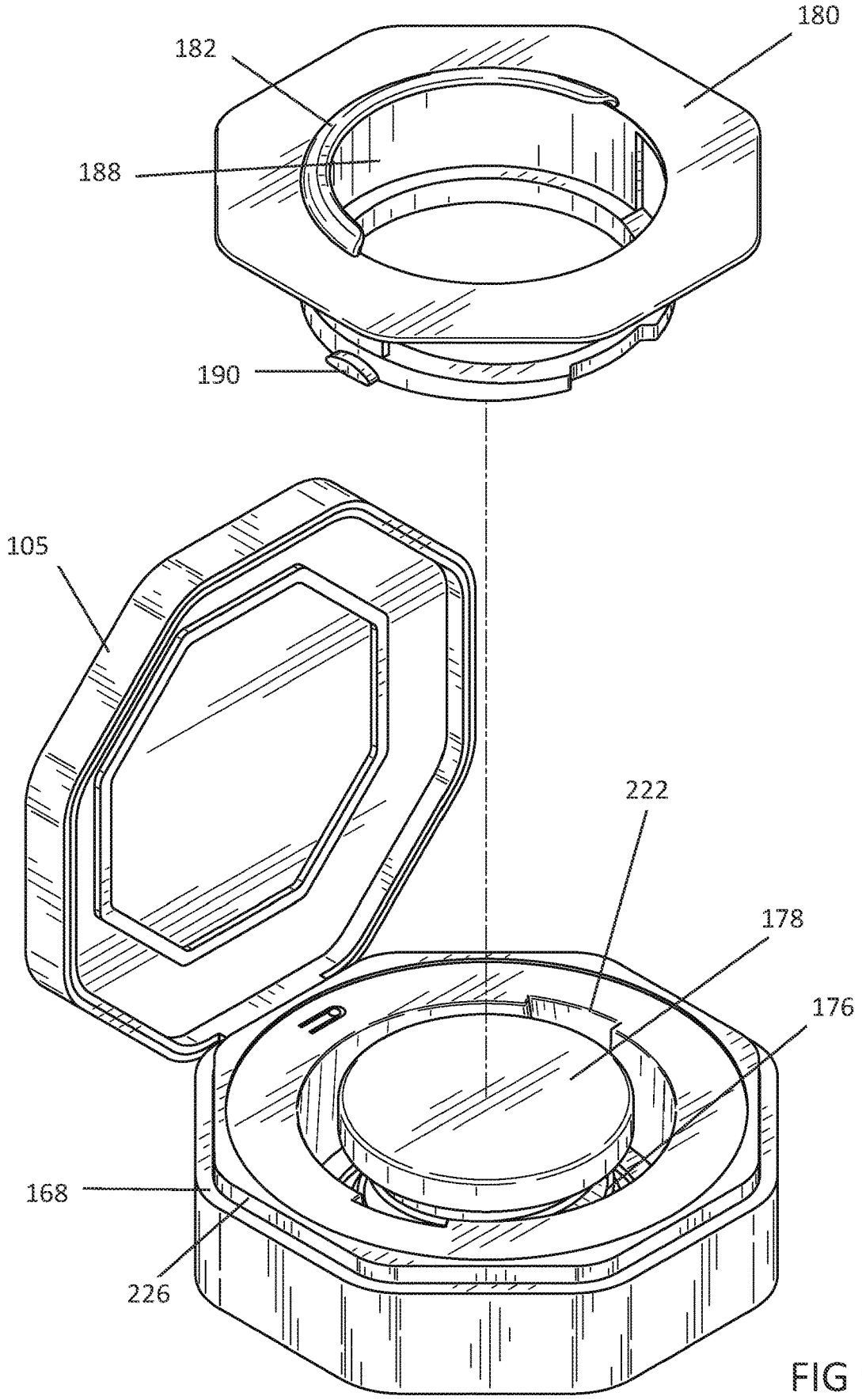
FIG. 9 is another partial exploded view showing the separation of the sleeve from the case in accordance with an embodiment of the invention.
Figure 10:
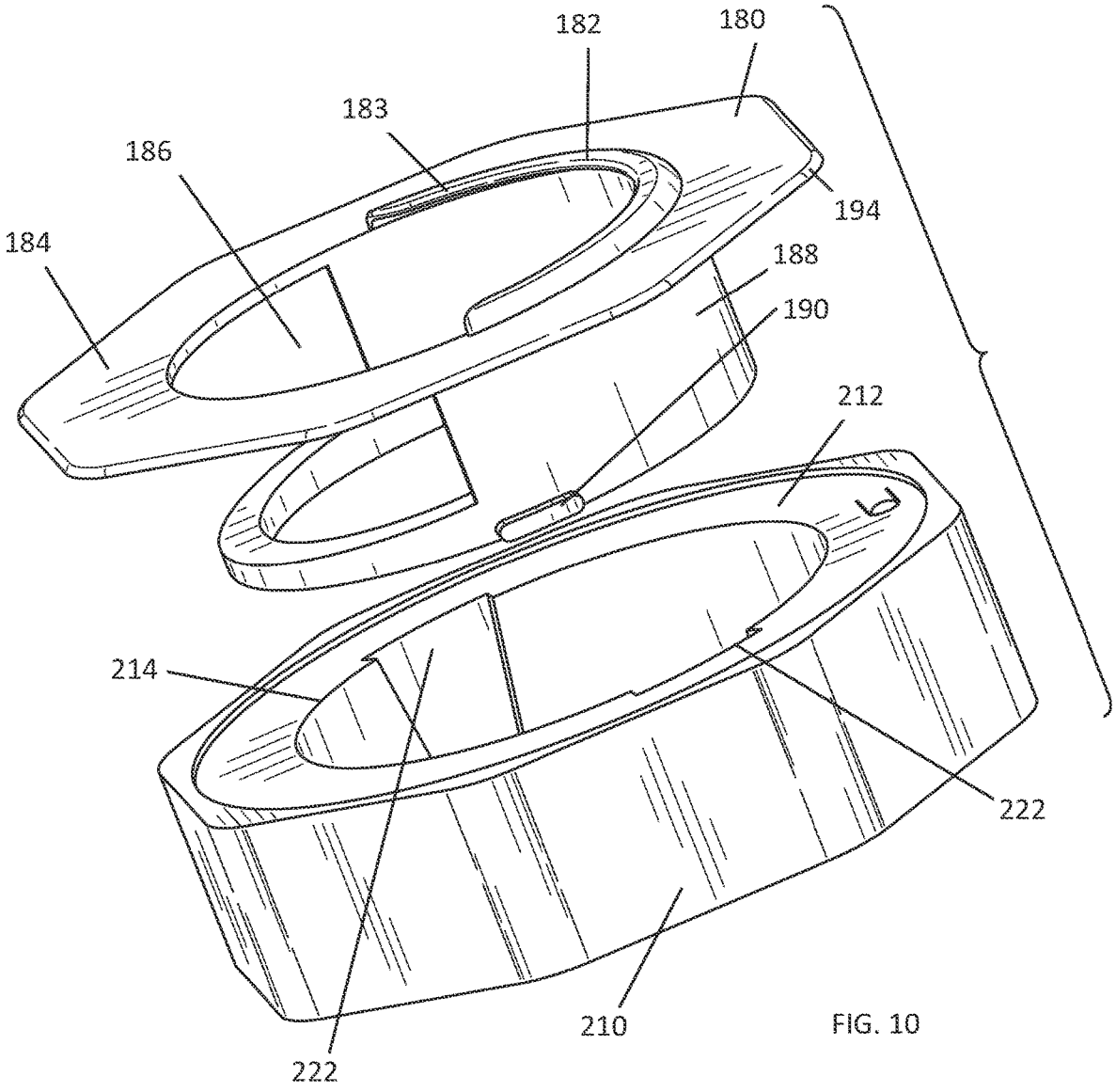
FIG. 10 is a partial exploded view showing the separation of the sleeve from the base in accordance with an embodiment of the invention.
Figure 11:
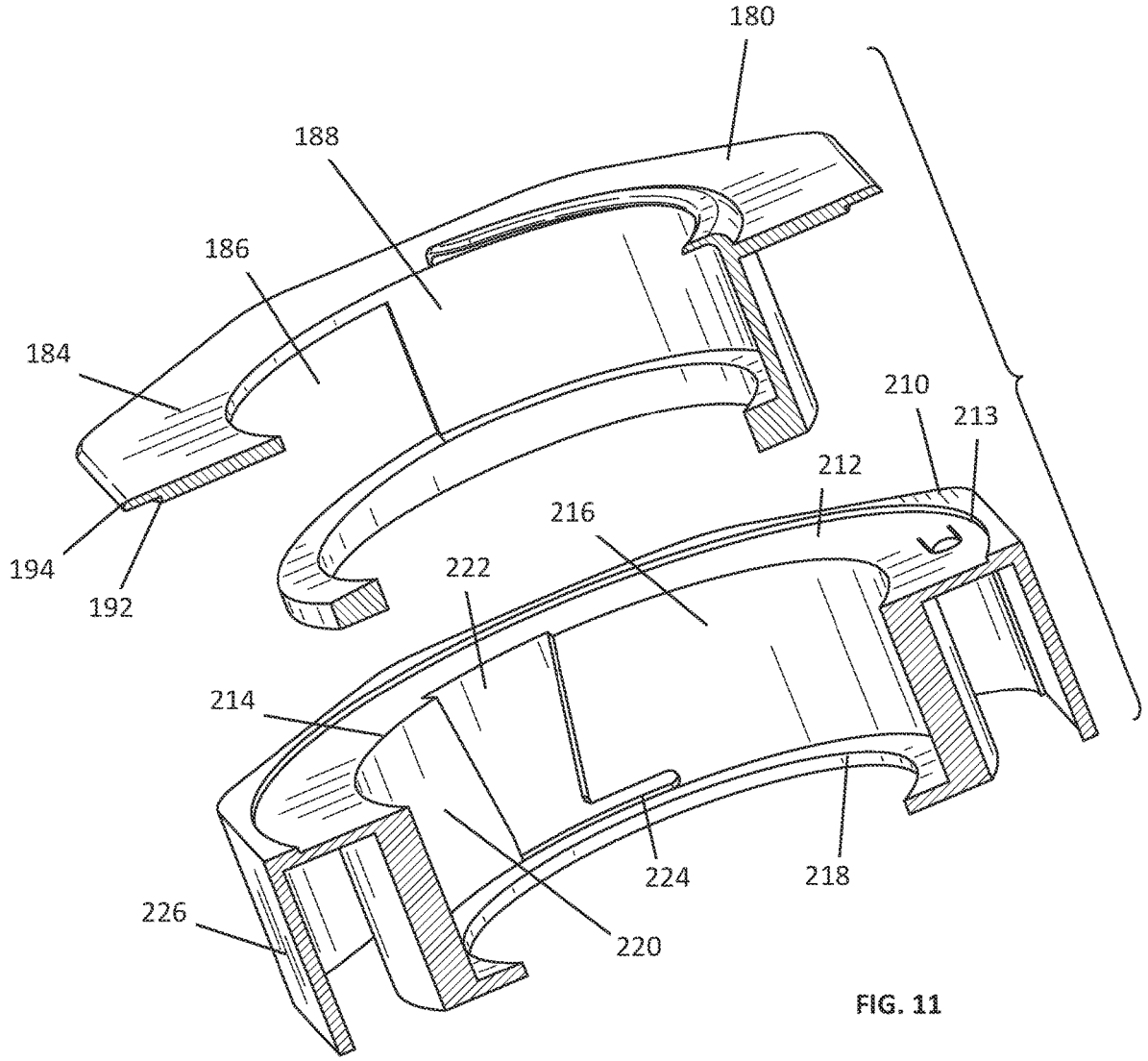
FIG. 11 is a sectional view of the separation of the sleeve from the base in accordance with an embodiment of the invention.
Figure 12:
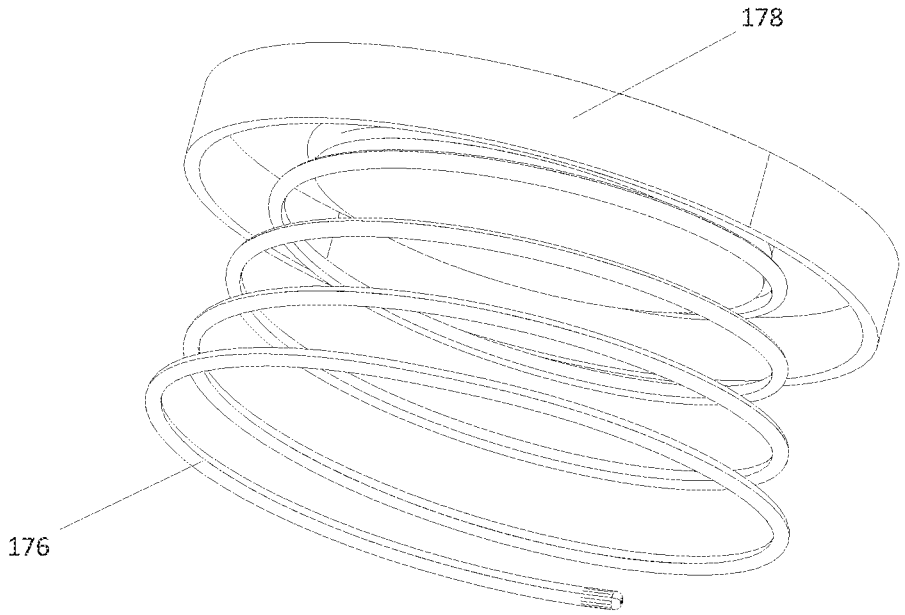
FIG. 12 is a perspective view of the spring and platform in accordance with an embodiment of the invention.
Figure 13:
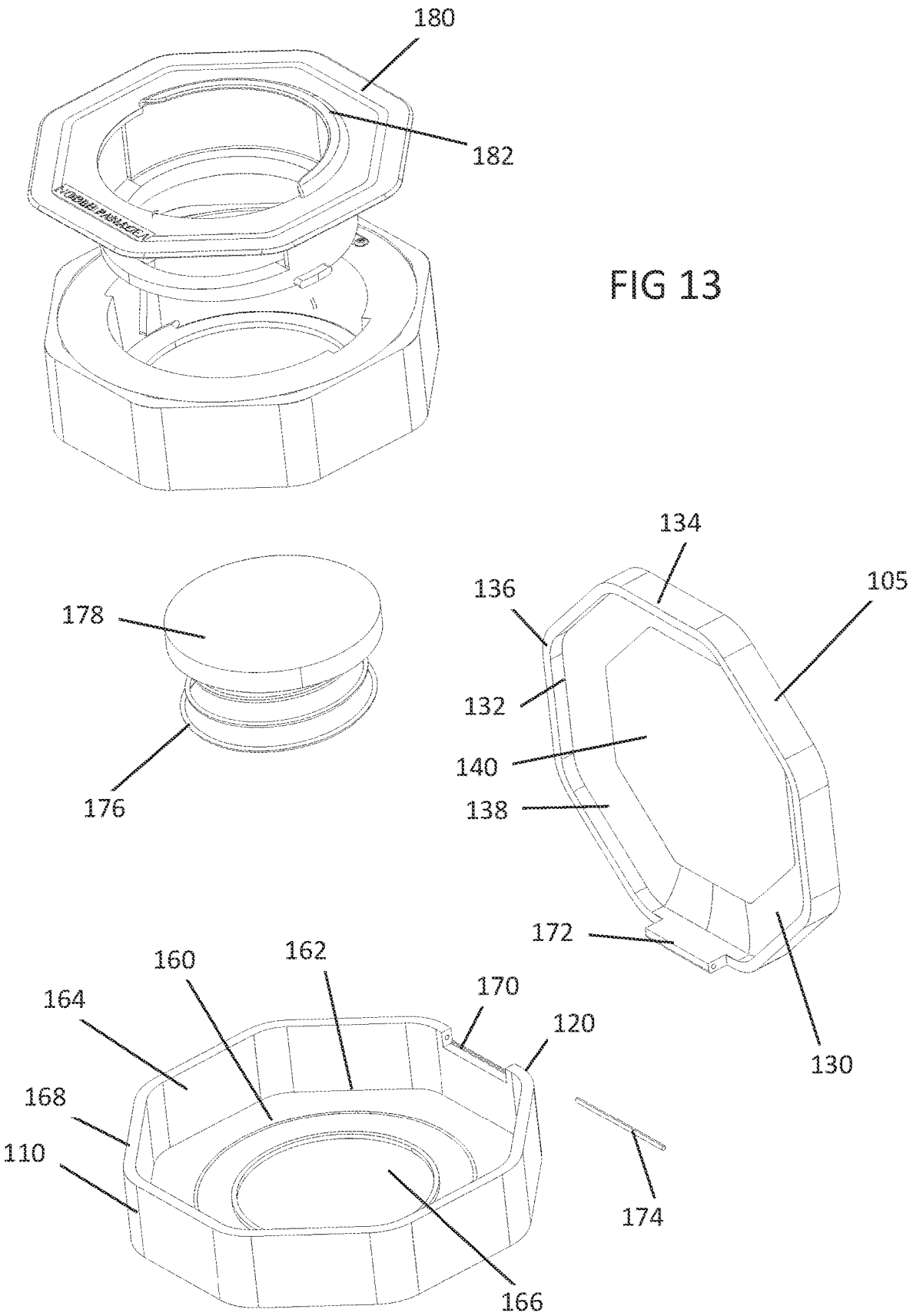
FIG. 13 is an exploded view of the case in accordance with an embodiment of the invention.

While the invention is susceptible to embodiments in many different forms, there are shown in the drawings and will be described in detail herein the preferred embodiments of the present invention. It should be understood, however, that the present disclosure is to be considered an exemplification of the principles of the invention and is not intended to limit the spirit or scope of the invention and/or claims of the embodiments illustrated.

Referring now to the figures, FIGS. 1 through 13, there is shown a cosmetic case 100. While the illustration of the case is in an octagonal polygon, the actual shape of the case can be changed while maintaining the functionality of the case 100. The case includes a lid 105 connected to a base 110 by a hinge pin 115 along the rear portion 120 of the case 100.

The lid 105 includes a top surface 130 which extends to a terminal edge 132. A shoulder section 134 extends from the terminal edge downwardly towards the base 110 and ends at a shoulder lip 136 along the entire shoulder section 134. In addition, the inner surface 138 of the top surface 130 includes an indented profile 140 to accommodate a raised portion 182 defined on the sleeve 180 (described in greater detail below).

As provided the lid 105 is hinged to the base 110. The base 110 includes a lower surface 160, which terminates to a base edge 162 and then extends upwardly along a base side wall 164 to create a well 166 therebetween. The base side wall 164 extends to a side wall upper edge 168. The base side wall 164 further includes a gap 170 along the upper edge 168 and along the rear portion 120 to accommodate a flange 172 extending from the lid 105 and which aligns with openings for a pin 174 all to form the hinge pin 115. The lower surface 160 accommodates a spring 176 that is compressed between the lower surface 160 and a platform 178. The spring 176 biases the platform away from the base such that when a sachet 200 is removed, the platform 178 pushes the next sachet upwards.

As mentioned above, the case 100 includes a sleeve 180 that is removable from the base 110. This is accomplished by includes a substructure 210 fitted and secured into the well 166 defined by the base 110. The substructure 210 includes a top ridge 212 extending radially inwards towards an inner periphery edge 214. A inside surface wall 216 extends from the inner periphery edge 214 downwardly towards a lower ridge 218 that extends radially inward. The lower ridge 218 is adjacent the lower surface 160. This also creates a sub-well 220. The inside surface wall 216 includes a channel 222 extending from the inner periphery edge 214 to the lower ridge 218. The channel 222 is wider near the inner periphery edge 214 and tapers to a narrower opening near the lower ridge 218. The channel 222 further includes a notch 224 adjacent the channel at the lower ridge 218. This allows for the sleeve 180 to slide down and twist to secure in place. In addition, the substructure 210 has an outside surface wall 226 that when the substructure 210 is positioned in the base well 166 extends at a height above the upper edge 168 of the base side wall 164. This prevents the upper edge 168 to come into contact with the shoulder lip 136; leaving a gap 228 between the lid and base when in a closed configuration.

The sleeve 180 includes a top surface region 184 extending inwardly into a sleeve well 186 with a defined sleeve well side wall 188. The sleeve well 186 is shaped to accommodate the sachets. As noted above the top surface region 184 further includes a raised portion 182 that has a curved profile 183 that hangs over a portion of the sleeve well 186 in order to hold the sachets down against the force of the spring. The sleeve well side wall 188 includes a side opening 189 under the top surface region 184 to allow for the replacement of sachets. In addition, outside of the sleeve well side wall 188 includes a pair of protruding knobs 190 positioned such that each knob slides in the channel 222 and notch 224 of the substructure 210.

Lastly, under the top surface region 184 there is a circular extension 192 around the terminal edge 194 sized to fit into a circular indentation 213 on the substructure, thus when the sleeve well 186 is fitted into the sub-well 220 the sleeve 180 is able to twist about the substructure even if the outer profile is a polygon. The protruding knobs 190 acting within the channel and notch provide for twisting stops to prevent the sleeve from being over twisting or misaligned.

It is further possible that the substructure and the base are a unitary piece molded together to prevent separation or for ease of production.

Figure 14:
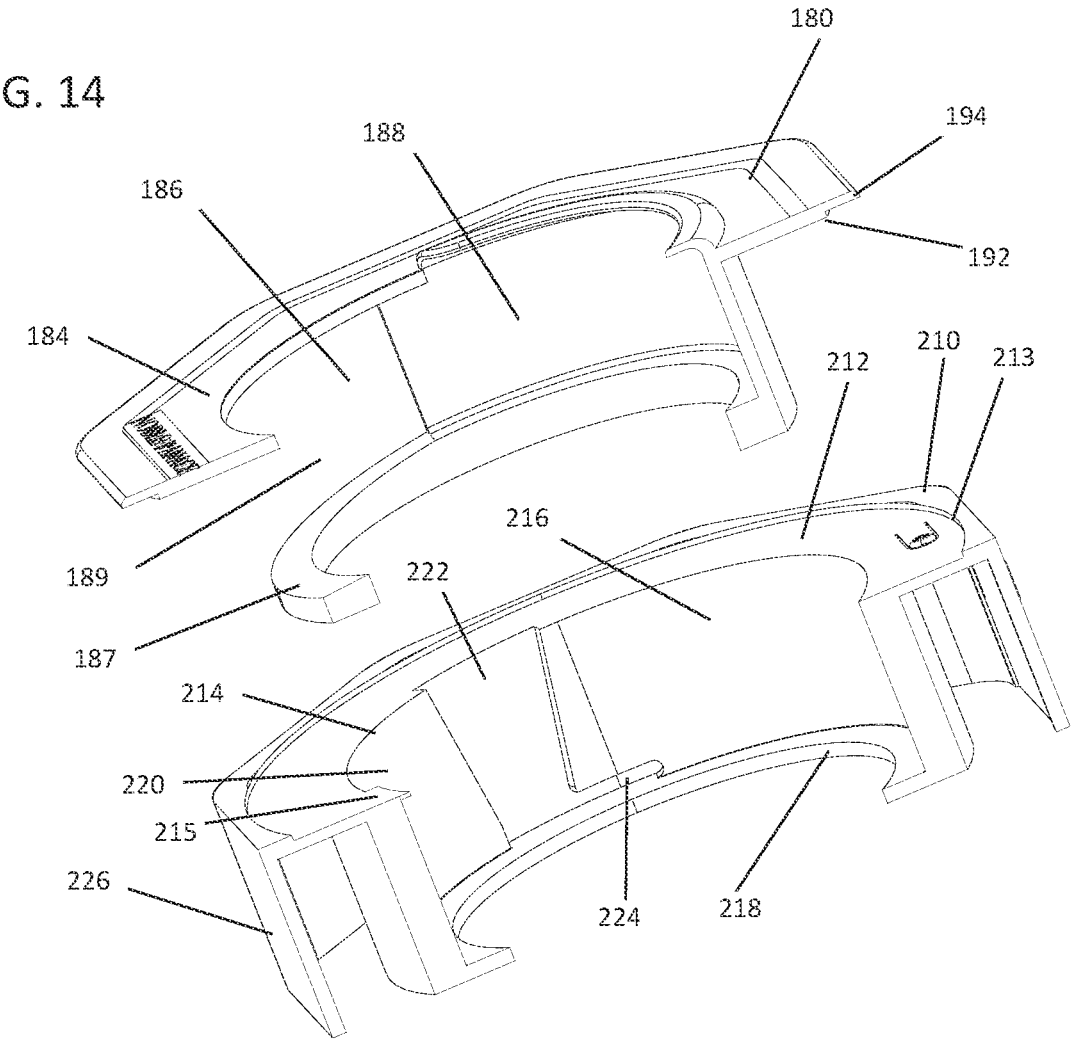
FIG. 14 is a sectional view of the separation of the sleeve from the base in accordance with an embodiment of the invention.

For use of the case 100, the user twists the sleeve and pulls up to gain access to the side opening 189 to refill the sachets. In one embodiment the sleeve can complete be removed but it is possible to prevent the removal of the substructure. In FIG. 14, the substructure 210 includes an overhang stop 215 configured to catch a bottom ridge 187 defined at the bottom of the side opening 189 to prevent the removal of the sleeve from the substructure 210 but still allows access to the opening to refill the sachets.

From the foregoing and as mentioned above, it is observed that numerous variations and modifications may be effected without departing from the spirit and scope of the novel concept of the invention. It is to be understood that no limitation with respect to the embodiments illustrated herein is intended or should be inferred. It is intended to cover, by the appended claims, all such modifications within the scope of the appended claims.

We claim:

1. A cosmetic case for holding at least one sachet, comprising:

a lid connected to a base by a hinge along a rear portion of the case;

wherein the base includes:

a base lower surface terminating at a base edge; a continuous base side wall extending upwardly from the base edge to define a base well; and the base side wall extending to a base side wall upper edge;

a spring secured at one end to the base lower surface, and having another distal end secured to a platform such that the spring biases the platform away from the base lower surface;

a base substructure fitted and secured into the base well;

wherein the substructure includes:

a top ridge extending radially inward towards a circular indentation and then an inner periphery edge; an inside surface wall extends from the inner periphery edge downwardly towards a lower ridge that extends radially inward, wherein the lower ridge is adjacent the base lower surface, and defining a sub-well within the inside surface wall; at least one channel along the inside surface wall extending from the inner periphery edge to the lower ridge, the at least one channel further including a longitudinal directed notch near the lower ridge;

a sleeve removably fitted into the base substructure; the sleeve includes:

a top surface region extending inwardly to a sleeve side wall extending downwardly to define a sleeve well; the top surface region further has a raised overhang lip that hangs over a portion of the sleeve well; a side opening under the top surface region, the side opening configured to receive the at least one sachet; and at least one protruding knob positioned on an outside of the sleeve side wall and configured to slide in the at least one channel and notch, the sleeve is configured to be removed from the substructure or secured within the substructure; and at least one sachet shaped to be held in the sleeve well and being removable when the lid is in an open configuration.

2. The cosmetic case of claim 1, wherein the sleeve further includes a circular extension around a terminal edge of the top surface region, the circular extension being sized to fit into a circular indentation defined on the top ridge of the substructure, thus when the sleeve well is fitted into the sub-well the sleeve is able to twist within the substructure.

3. The cosmetic case of claim 1, wherein the at least one channel includes two channels distally positioned around the inside surface wall, each channel separately accommodating a corresponding one of the protruding knobs defined on the sleeve.

4. The cosmetic case of claim 3, wherein each channel is wider near the inner periphery edge and tapers to a narrower opening near the lower ridge.

5. The cosmetic case of claim 1, wherein the lid includes: a lid top surface extending to a lid terminal edge; a lid shoulder section extending from the lid terminal edge downwardly towards the base and ending at a lid shoulder lip; and a lid inner surface including an indented profile.

6. The cosmetic case of claim 5, wherein the substructure has an outside surface wall that extends to a height above the base side wall upper edge, configured to prevent the base side wall upper edge from coming into contact with the lid shoulder lip, to define a gap between the lid and base when the case is in a closed configuration.

7. The cosmetic case of claim 5, wherein the indented profile on the lid inner surface is configured to accommodate the raised overhang lip defined on the sleeve.

8. The cosmetic case of claim 1, wherein the base side wall includes a gap along the base side wall upper edge and along the rear portion to accommodate a flange extending from the lid and which aligns with openings for a pin to form the hinge.

9. The cosmetic case of claim 1 further comprising an overhang stop extending over the sub-well and configured to come into contact with a portion of a bottom ridge defined at a bottom of the side opening in the sleeve to prevent the complete removal of the sleeve from the substructure.

10. A cosmetic case for holding at least one sachet, comprising:

a lid connected to a base substructure by a hinge along a rear portion of the case;

wherein the base substructure includes:

a base substructure lower surface terminating along an outside wall that extends upwardly to a top ridge which extends radially inwardly towards a circular indentation and then an inner periphery edge, the base substructure further includes an inside surface wall extending from the inner periphery edge downwardly towards the base substructure lower surface to define a sub-well; at least one channel along the inside surface wall extending from the inner periphery edge towards the base substructure lower surface, the at least one channel further including a longitudinal directed notch near the base substructure lower surface;

a sleeve removably fitted into the base substructure; the sleeve defined to include:

a top surface region extending inwardly to a sleeve side wall, the sleeve side wall extending downwardly to define a sleeve well, the top surface region includes a raised overhang lip that hangs over a portion of the sleeve well, a side opening under the top surface region configured to receive the at least one sachet; and at least one protruding knob positioned on an outside of the sleeve side wall and configured to slide in the channel and notch, thereby the sleeve is configured to be removed from the substructure or secured within the substructure; and a spring secured at one end to the base substructure lower surface, and having another distal end secured to a platform such that the spring biases the platform away from the base substructure lower surface;

at least one sachet, shaped to be held in the sleeve well and being removable when the lid is in an open configuration.

11. The cosmetic case of claim 10, wherein the sleeve further includes a circular extension around a terminal edge of the top surface region, the circular extension being sized to fit into a circular indentation defined on the top ridge of the substructure, thus when the sleeve well is fitted into the sub-well the sleeve is able to twist within the substructure.

12. The cosmetic case of claim 10, wherein the at least one channel includes two channels distally positioned around the inside surface wall, each channel separately accommodating a corresponding one of the protruding knobs defined on the sleeve.

13. The cosmetic case of claim 12, wherein each channel is wider near the inner periphery edge and tapers to a narrower opening near the lower ridge.

14. The cosmetic case of claim 10, wherein the lid includes: a lid top surface extending to a lid terminal edge; a lid shoulder section extending from the lid terminal edge downwardly towards the base and ending at a lid shoulder lip; and a lid inner surface including an indented profile.

15. The cosmetic case of claim 14, wherein the indented profile on the lid inner surface is configured to accommodate the raised overhang lip defined on the sleeve.

16. The cosmetic case of claim 10, wherein the substructure has an outside surface wall that extends to a height above the base side wall upper edge, configured to prevent the base side wall upper edge from coming into contact with the lid shoulder lip, to define a gap between the lid and base when the case is in a closed configuration.

17. The cosmetic case of claim 10 further comprising an overhang stop extending over the sub-well and configured to come into contact with a portion of a bottom ridge defined at a bottom of the side opening in the sleeve to prevent the complete removal of the sleeve from the substructure.

18. A cosmetic case for holding at least one sachet, comprising:

a lid connected to a base by a hinge along a rear portion of the case;

wherein the base includes:

a base lower surface terminating to a base edge; a continuous base side wall extending upwardly from the base edge to define a base well; and the base wall extending to a base side wall upper edge;

a spring secured at one end to the base lower surface, and having another distal end secured to a platform such that the spring biases the platform away from the base lower surface;

a base substructure fitted and secured into the base well;

wherein the substructure includes:

a top ridge extending radially inwards towards a circular indentation and then an inner periphery edge; an inside surface wall extends from the inner periphery edge downwardly towards a lower ridge that extends radially inward, wherein the lower ridge is adjacent to the base lower surface, and the inside surface wall defines a subwell; at least one channel along the inside surface wall extending from the inner periphery edge to the lower ridge, the at least one channel further including a longitudinal directed notch near the lower ridge;

a sleeve removably fitted into the base substructure; the sleeve includes a top surface region extending inwardly to a sleeve side wall extending downwardly to define a sleeve well; the top surface region further has a raised overhang lip that hangs over a portion of the sleeve well; a side opening under the top surface region configured to receive the at least one sachet; and at least one protruding knob positioned on an outside of the sleeve side wall and configured to slide in the channel and notch, thereby the sleeve is configured to be removed from the substructure or secured within the substructure;

the at least one sachet being shaped to be held in the sleeve well and being removable when the lid is in an open configuration; and wherein the sleeve further includes a circular extension extending from a terminal edge of the top surface region, the circular extension being sized to fit into the circular indentation defined on the top ridge of the substructure, when the sleeve is fitted into the sub-well the sleeve is able to turn within the substructure.

19. The cosmetic case of claim 18, wherein the lid includes: a lid top surface extending to a lid terminal edge; a lid shoulder section extending from the lid terminal edge downwardly towards the base and ending at a lid shoulder lip; and a lid inner surface including an indented profile.

* * * * *